United States Patent [19]

Skinner et al.

[11] Patent Number: 5,015,982

[45] Date of Patent: May 14, 1991

[54] IGNITION COIL

[75] Inventors: Albert A. Skinner; Ronnalee House, both of Anderson; Roger W. Kellams, Carmel; Jose A. Cruz, Chesterfield, all of Ind.

[73] Assignee: General Motors Corporation, Detroit, Mich.

[21] Appl. No.: 391,816

[22] Filed: Aug. 10, 1989

[51] Int. Cl.[5] ..... H01F 17/06; H01F 27/26

[52] U.S. Cl. ..... 336/69; 336/83; 336/178; 336/212; 336/233

[58] Field of Search ..... 336/233, 212, 178, 234, 336/84 M, 83, 96, 198, 69, 70, 210; 123/634, 635

[56] References Cited

U.S. PATENT DOCUMENTS

| | | | |
|---|---|---|---|
| 952,692 | 3/1910 | Thordarson | 336/83 X |
| 1,815,380 | 7/1931 | Porter et al. | 336/83 |
| 2,885,458 | 5/1959 | Hause | 123/635 |
| 2,904,763 | 9/1959 | Harruff | 336/182 |
| 2,962,679 | 11/1960 | Stratton | 336/83 |
| 3,235,675 | 2/1966 | Blume | 336/83 X |
| 3,332,049 | 7/1967 | Hisano | 336/83 |
| 3,371,301 | 2/1968 | Hisano | 336/83 |
| 3,566,202 | 2/1971 | Carr | 336/233 X |
| 3,566,323 | 2/1971 | Graf et al. | 336/233 |
| 3,750,069 | 7/1973 | Renskers | 336/83 |
| 4,032,837 | 6/1977 | Panu | 336/178 X |
| 4,047,138 | 9/1977 | Steigerwald | 336/178 X |
| 4,048,972 | 9/1977 | Worz | 336/96 X |
| 4,424,504 | 1/1984 | Mitsui et al. | 336/83 |
| 4,517,540 | 5/1985 | McDougal | 336/232 X |
| 4,543,208 | 9/1985 | Honie et al. | 336/233 X |
| 4,601,765 | 7/1986 | Soileau et al. | 75/234 |

*Primary Examiner*—Thomas J. Kozma
*Attorney, Agent, or Firm*—C. R. Meland

[57] ABSTRACT

An ignition coil for developing spark plug firing voltages. The magnetic current for the coil comprises an axially extending core that joins axially spaced annular parts. The core and parts can be formed of iron particles in a binder of electrical insulating material. A primary winding is disposed about the core and a secondary winding is disposed about the primary winding. An axially extending circular part that is formed of magnetic material is positioned to provide air gaps with outer surfaces of said annular parts. The circular part forms a shield that increases the capacitance of the secondary winding. The total stored magnetic energy does not vary substantially with variations in air gap length. The cross-sectional area A of the air gap is large as compared to the length L of the air gap so that the ratio A/L does not vary much with variations in L.

24 Claims, 3 Drawing Sheets

IGNITION COIL

This invention relates to ignition coils for developing a spark firing voltage that is applied to a spark plugs of spark ignited internal combustion engines.

Ignition coils utilize primary and secondary windings and a magnetic circuit. The magnetic circuit may be formed of steel laminations as disclosed in the House. U.S. Pat. No. 4,480,377. That patent points out that the magnetic circuit has an air gap and points out that the air gap must be adjusted during manufacture of the coil.

It has also been suggested in the Hause U.S. Pat. No. 2,885,458 to provide an ignition coil that has a circular core that can be formed of iron powder and a binder, such as a phenolic that is molded to shape.

One of the objects of this invention is to provide an ignition coil that has a magnetic circuit that includes one or more air gaps, but wherein the magnetic circuit is so arranged that the air gaps need not be adjusted during manufacture of the coil thereby eliminating the costly adjustment of the air gap in a manner set forth in the above-referenced House et al patent. This is accomplished by providing an ignition coil where the primary and secondary windings are disposed about a center core of magnetic material The core is in a magnetic circuit with a pair of annular magnetic parts or pole pieces that have outer cylindrical surfaces. A cylindrical part of magnetic material forms a return path for magnetic flux and is spaced from the outer cylindrical surfaces of the pole pieces to form an air gap therewith. The cross-sectional area of these air gaps is many times larger than the cross-sectional area of an air gap like the gap used in the center leg of the magnetic circuit of the above-referenced House et al patent. Since coil inductance is generally related to the ratio of A/L where A is the cross-sectional area of the total air gap and where L is the length of the air gap it can be seen that by making A large, variations in L have little effect on inductance. Accordingly, this invention makes A large with the result that L need not be adjusted during manufacture of the coil to obtain an inductance that falls within an acceptable range of values.

In regard to providing an ignition coil that does not require the adjustment of the air gap length L, the coil of this invention is arranged such that the portions thereof are formed of a magnetic material that, in effect, provides many small air gaps. This material can be a composite material of iron powder particles and an electrical insulating material. The insulating material separates the particles and binds them together and provides many air gaps between the particles that act like air gaps. During operation of the coil, magnetic energy is stored in the many gaps of the composite material and in the air gaps between the pole pieces and the cylindrical part, that has an air gap length L. The total magnetic energy that is stored in the magnetic circuit is the energy stored in the gaps of the composite material added to the energy stored in the air gaps that have the length L. The total magnetic energy that is stored, with the arrangement that has been described, does not vary substantially with variations in air gap length L over a certain range.

Another object of this invention is to provide an ignition coil of the type described where the pole pieces are formed of a composite iron powder and electrical insulating material where the particles of powder are coated by the insulating material and wherein the insulating material serves to insulate the particles from each other and to bind the particles together.

Still another object of this invention is to provide an ignition coil where an outer return path for magnetic flux generated in a core member is provided by a part that is formed of magnetic material which also serves as a shield to limit the open-circuit voltage developed by the secondary winding of the coil. The part is a cylindrical split shield that is disposed about the coil windings of a segment-wound secondary coil. The shield operates to increase the capacitance of the secondary winding thereby limiting its open-circuit voltage and also forms a flux return path.

Another object of this invention is to provide an ignition coil assembly that is complete and testable prior to being dropped into an outer supporting case. This allows the same production line to build coils for many different applications and for differing cases and terminations of the coil windings Still another object of this invention is to provide an ignition coil where the inductance of the coil varies as a function of primary winding break current. The variation in inductance is such that above a certain magnitude of break current the inductance decreases with increasing primary winding break current.

IN THE DRAWINGS

Figure 1:
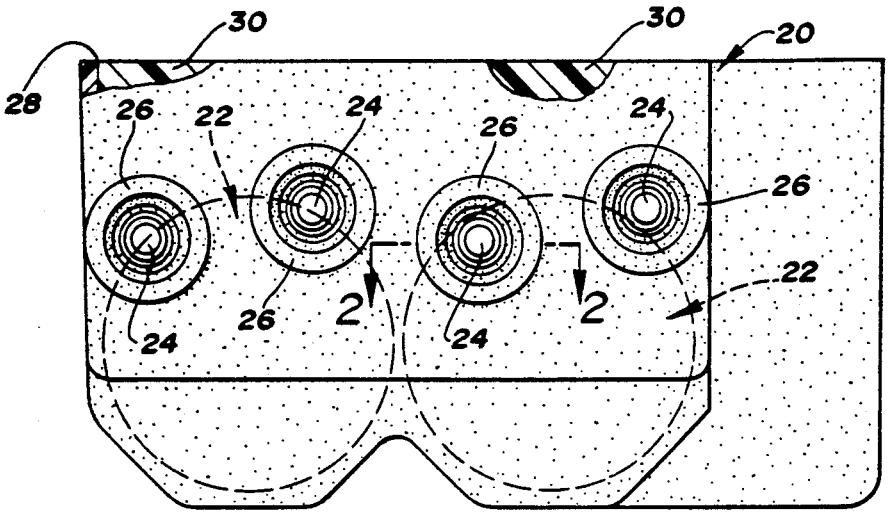
FIG. 1 is a side view with parts broken away of an ignition coil assembly.
Figure 2:
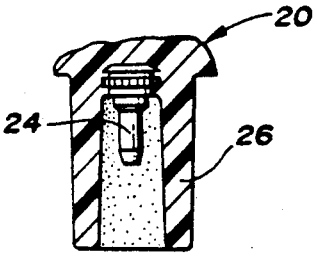
FIG. 2 is a sectional view taken along line 2—2 of FIG. 1.

Referring now to the drawings, and more particularly to FIG. 1, the reference numeral 20 designates an outer case or housing that is formed of a plastic insulating material. The housing has walls defining an internal chamber area that receives two ignition coil assemblies, each designated as 22 and shown in dotted lines in FIG. 1. The secondary winding of a given coil assembly is connected to a pair of male terminals. The secondary winding of the other coil is connected to another pair of male terminals. The male terminals have each been designated as 24 and one of the terminals 24, and associated tower 26, is shown in FIG. 2. Tower 26 is integral with outer case 20.

The case 20 forms an enclosure that is open at the end designated as 28. In the manufacture of ignition coils, the coil assembly 22 is made so that it is a complete unit that is testable prior to being dropped into case 20 through the open end of the case. After coil assemblies 22 have been dropped into case 20 and electrical connections have been made to terminals, like terminal 24, a potting compound that is formed of electrical insulating material is used to fill the interior of case 20 and to encapsulate the coil assemblies 22. The potting compound is applied to the interior of case 20 through its open end. Some of the potting compound is shown in FIG. 1 and designated as 30. It, of course, closes the open end of case 20.

The ignition coil apparatus shown in FIGS. 1 and 2 is for a four-cylinder engine and is for a so-called distributorless ignition system where a given secondary winding is connected to two spark plugs.

Figure 3:
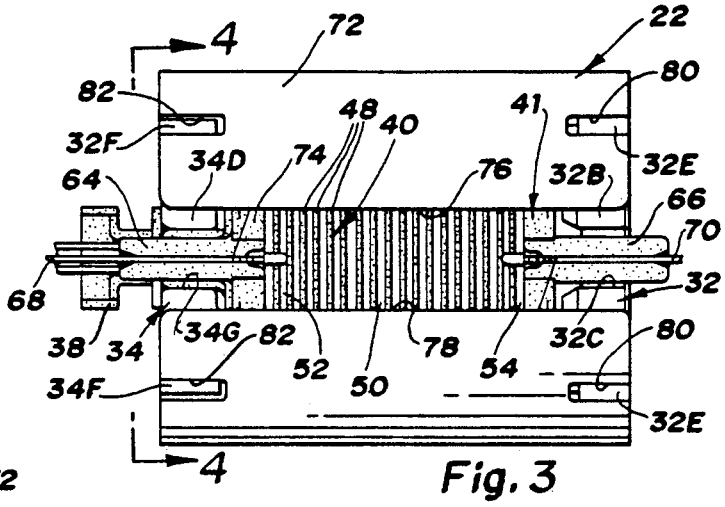
FIG. 3 is a plan view of an ignition coil assembly made in accordance with this invention.
Figure 4:
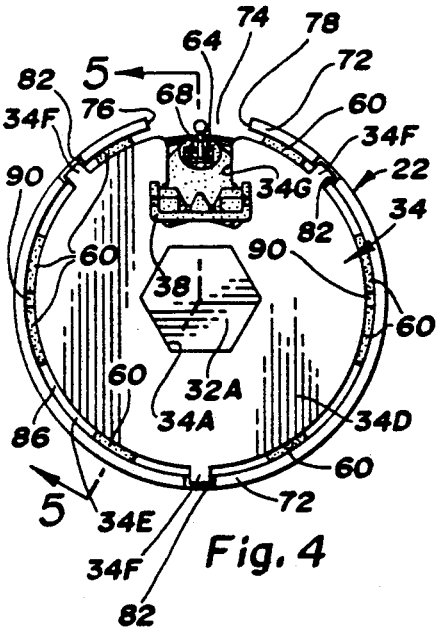
FIG. 4 is an end view of the assembly shown in FIG. 3 looking in the direction of arrows 4—4.
Figure 5:
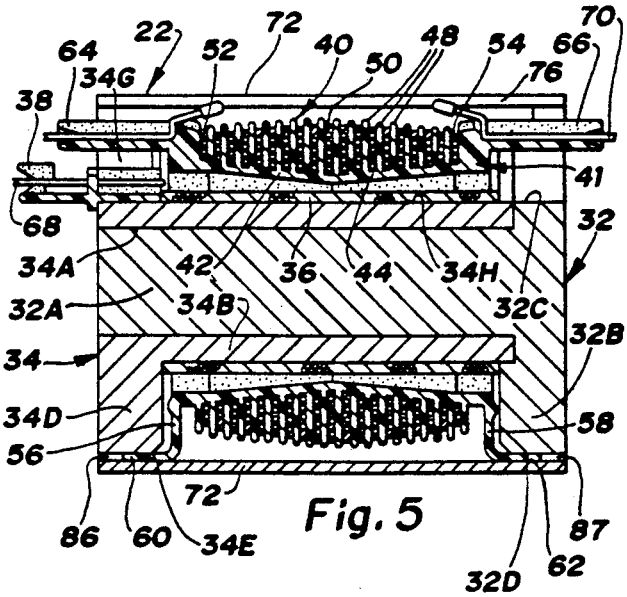
FIG. 5 is a sectional view taken along line 5—5 of FIG. 4.

The ignition coil assembly 22 is shown in FIGS. 3–5. The assembly includes two magnetic parts 32 and 34. These parts are formed of composite iron powder particles and electrical insulating material which are compacted or molded to the shape shown. The particles of iron powder are coated with the insulating material. The insulating material forms gaps, like air gaps, between the particles and also serves to bind the particles together. This composite material will be described in more detail hereinafter.

Figure 8:
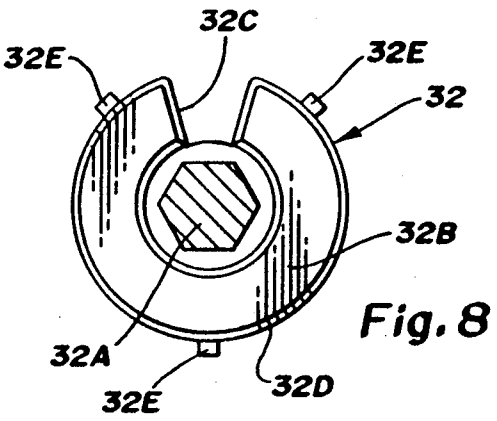
FIG. 8 is a sectional view taken along line 8—8 of FIG. 6.

The magnetic part 32 has an axially extending core portion 32A that is integral with an end wall portion 32B. It can be seen in FIG. 8 that portion 32B is annular and has a notch 32C. Portion 32B has a circular outer wall 32D and a plurality of radially extending lugs or bosses 32E. It can be seen from FIG. 8 that the core portion 32A has a hexagonal cross-section or outline throughout its length.

Figure 6:
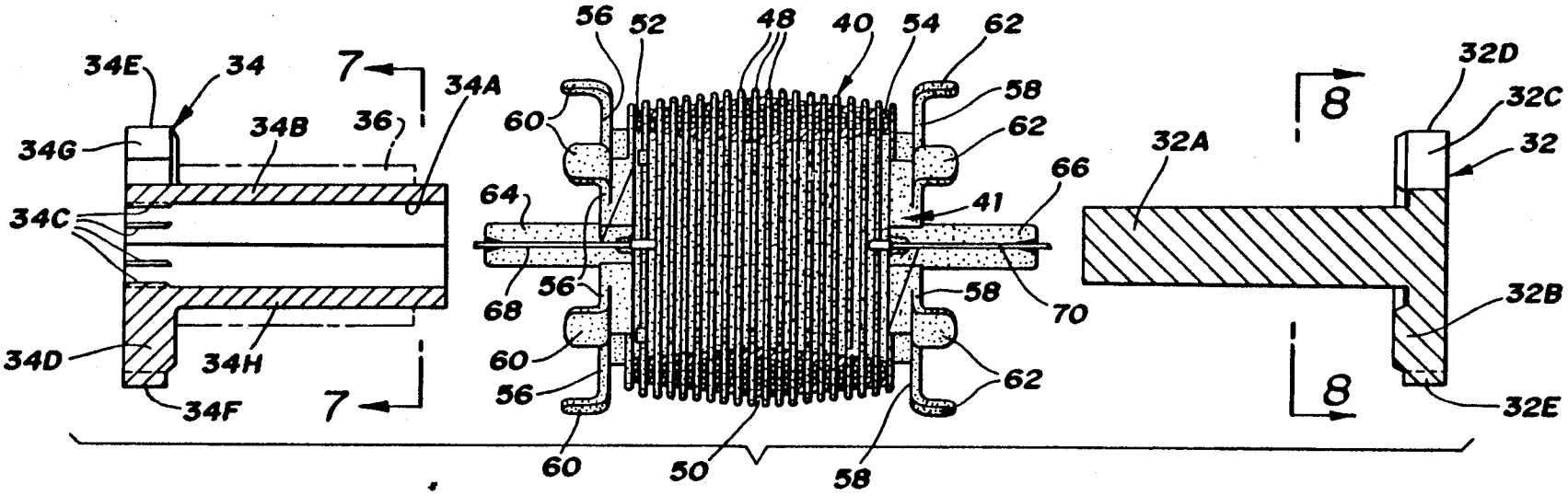
FIG. 6 is view of the three components that are used in the ignition coil assembly shown in FIG. 5.
Figure 7:
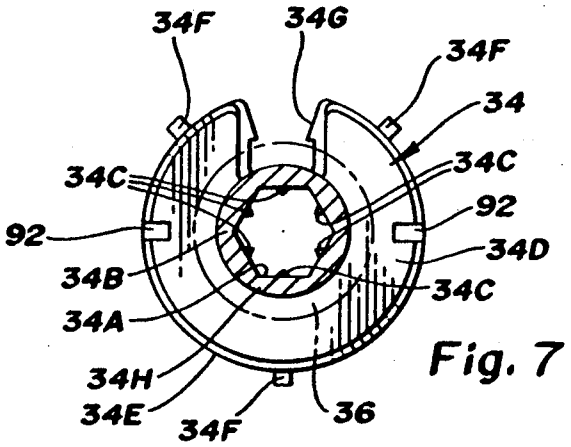
FIG. 7 is a sectional view of a magnetic part taken along line 7—7 of FIG. 6.

The hexagonal core portion 32A fits into a hexagonal bore 34A formed in an axially extending core portion 34B of part 34. FIGS. 6 and 7 illustrate part 34 in detail. A portion of the hexagonal bore 34A is provided with six axially extending ribs each designated as 34C. Part 34 has an annular end wall portion 34D that is integral with portion 34B and it has an outer circular surface 34E. Part 34 further has lugs 34F and a notch 34G.

The dimensions of core portion 32A and bore 34A are such that walls of the parts engage each other when hexagonal part 32A is inserted into hexagonal bore 34A. However, when parts 32 and 34 are assembled to each other, there is an interference fit between ribs 34C and an end portion of core portion 32A. This interference fit secures parts 32 and 34 to each other. It will be appreciated that when portion 32A is assembled into bore 34A, the end face of tubular portion 34B will engage or bottom out against a surface of portion 32B.

The ignition coil has a primary winding 36 which is formed of insulated wire, the inner turns of which are wound directly on the outer cylindrical surface 34E of core portion 34B. This primary winding may be comprised of two winding layers each being comprised of sixty-two turns of No. 23 AWG wire. Since the primary winding 36 is wound directly on the outer surface 34H of portion 34B, heat generated in winding 36 is transferred to portion 34B which acts as a heat radiator.

In the manufacture of the ignition coil, the part 34 and the primary winding 36 form a primary winding unit or assembly that is manufactured and subsequently assembled to other parts of the coil in a manner that will be described. To make the primary winding unit, primary winding 36 is wound on portion 34B. The end leads of the primary winding 36, after winding, are supported by an insulator 38 that is supported in the notch 34G.

The ignition coil has a secondary winding unit that is disposed about the primary winding 36, which is generally designated as 40. This unit is shown in FIGS. 5 and 6. This unit comprises a one-piece spool 41 that is formed from a molded plastic insulating material. This spool has inclined portions 42 and 44 which carry a plurality of axially spaced and circumferential extending ribs each designated as 48. The ribs 48 and surfaces of portions 42 and 44 define a plurality of axially spaced winding slots each of which contains a coil winding. There are nineteen slots and nineteen axially spaced coil windings shown in FIG. 5. The coil winding in the center of the coil spool has been designated as 50 and the coil windings at each end of the spool have been designated respectively as 52 and 54. Coil winding 50 has more turns than either coil windings 52 and 54 and as one progresses from coil windings 52 or 54 toward center winding 50, the number of turns of a coil winding increases. By way of example, coil 50 may be comprised of 780 turns of No. 42 AWG wire whereas coil windings 52 and 54 may each be comprised of 318 turns of this wire. As one goes from either coil 52 or 54 toward center coil 50 the number of turns for each successive coil winding may be 480, 517, 556, 593, 630, 667, 706 and 743 turns. Thus, the two coils at either side of coil 50 will have 743 turns. It will be appreciated that all nineteen coils are connected in series by cross-over connections that extend through slots in ribs 48. It will also be appreciated that the secondary winding is what is known as a segment-wound coil since it is made up of a plurality of axially spaced winding segments.

The coil spool 41 for secondary unit 40 has end walls that carry a plurality of circumferentially spaced integral spokes or arms 56 at one end thereof and spokes or arms 58 at the other end thereof. Spokes 56 each have tang or spacer portion 60 that extend axially of the coil spool. In a similar fashion, arms 58 have axially extending tang or spacer portions 62.

The coil spool has integral terminal retainer portions 64 and 66 that support terminals 68 and 70 that are electrically connected to opposite ends of the secondary winding. The circumferential spacing of tangs 60 is shown in FIG. 4 and tangs 62 have the same spacing.

Disposed about secondary winding unit 40 is a part 72 that is formed of a magnetic material such as galvanized steel which may have a thickness of about 1.20 mm. The part 72 is shown in FIGS. 3–5 and as will be more fully described, it operates to provide a flux path for flux developed by primary coil 36 and as a shield. The part 72 has a circular shape, as can be seen in FIG. 4, and it is split to provide a gap 74 between edges 76 and 78 of part 72. The part 72 has three circumferentially spaced slots 80 at one end thereof and three circumferentially spaced slots 82 at the opposite end thereof. Part 72 may further have some openings (not illustrated) that allow potting compound to pass into the interior of part 72.

It can be seen in FIG. 5 that the tangs or spacers 60 serve to space an inner surface of part 72 from circular surface 34E of magnetic part 34. In this regard, outer surfaces of tangs 60 engage inner surfaces of part 72 and inner surfaces of tangs 60 engage outer circular surface 34E. This forms one radial air gap for the magnetic circuit of the ignition coil which is designated as 86. This air gap is between surface 34E and the portion or area of part 72 that is aligned with surface 34E. The tangs 62 perform the same function as tangs 60, that is, they provide another radial air gap 87, like air gap 86, that is between an inner surface of part 72 and circular surface 32D of part 32. In this regard, tangs 62 have the same thickness and circumferential spacing as tangs 60. Tangs 60 and 62 may be about 1.0 mm thick so that the radial length of radial air gaps 86 and 87 is about 1.0 mm.

The part 72 may be about 1.2 mm. thick and have a length of about 57 mm. The inner radius of part 72 may be about 21 mm. and the width of gap 74 can be about 12 mm.

Before proceeding with a further description of this invention, it will be helpful to explain the assembly steps that are used to assemble the coil. Assume that a primary unit is available, that is, a unit that is comprised of part 34 with the primary winding 36 wound thereon. The secondary assembly 40 is now assembled to the primary winding unit. When doing this, a pair of radially extending locator lugs 90 (FIG. 4) that are integral with the left end of coil spool 41 are inserted into radially extending recesses 92 (FIG. 7) or slots formed in the inner face of portion 34D of part 34. The tangs 60 are axially slipped over annular surface 34E. The shield 72 is now assembled by sliding it over secondary assembly 40. In doing this, the lugs 34F slide into the slots 82 of shield 72. During assembly of shield 72, it is sprung apart slightly so that it can clear tangs 60 and after assembly the part 72 springs back into engagement with outer surfaces of tangs 60. With the parts assembled as has been described, the final step is to assemble part 32 This is accomplished by inserting portion 32A of part 32 through secondary unit 40 and into the bore 34A of part 34. When doing this, lugs 32E slide into slots 80 and the left end of portion 32A slides into the area of bore 34A that has the ribs 34C. In the final assembled position of part 32, there is a press or interference fit between ribs 34C and the end of core portion 32A that prevents axial separation of parts 32 and 34. Further, the width of slots 80 relative to the width of lugs 32E is such that there is a press fit between lugs 32E and the surfaces of slots 80 that engage the lugs. This prevents axial movement of shield 72 relative to part 32 and provides an electrical connection between parts 72 and 32.

It is noted that parts 32 and 34 have been shown and described as each having three lugs 32E and 34F. In order to simplify the assembly, the parts 32 and 34 can be arranged so each part has only one lug. In such an arrangement, the lug 32E opposite notch 32C and the lug 34F opposite the notch 34G would be used and the other two lugs on each part eliminated. Shield 72 would now have only two slots, one at each end thereof positioned to receive the lugs.

It will be appreciated that when the coil has been assembled, as has been described, a complete unit has been made which is testable prior to being inserted as a unit into a case.

Figure 9:
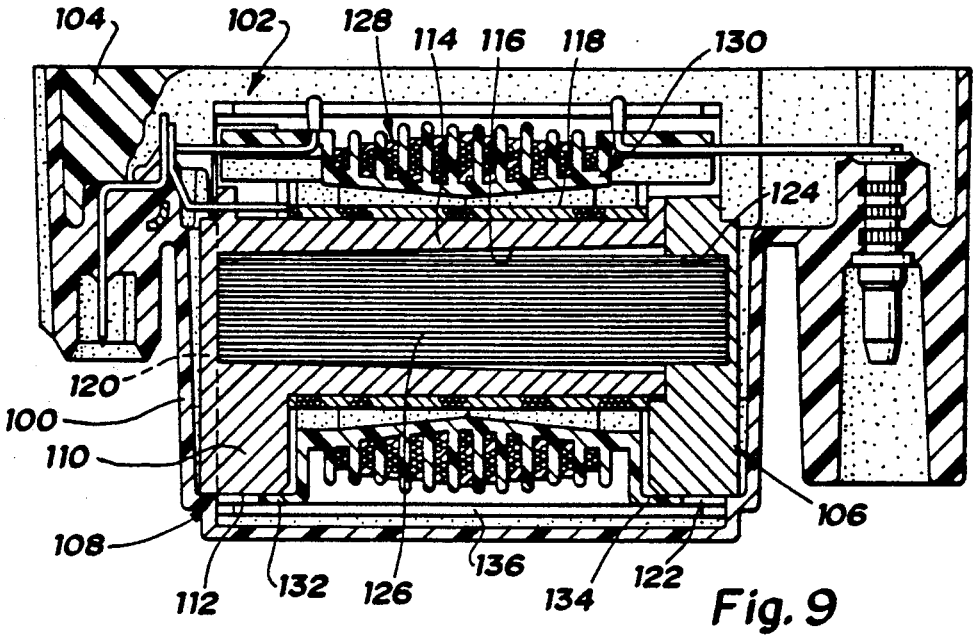
FIG. 9 is a sectional view of a modified ignition coil.
Figure 10:
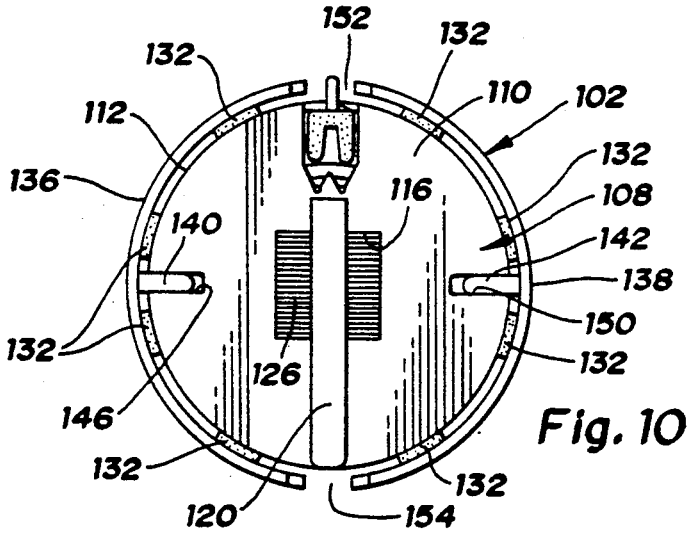
FIGS. 10 and 11 are, respectively, end and side views of an ignition coil assembly that is used in the ignition coil of FIG. 9.
Figure 11:
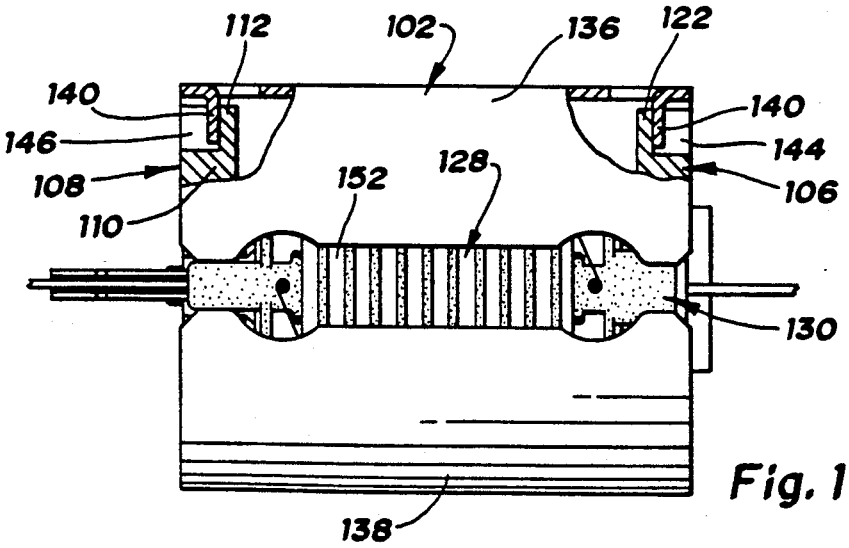

Referring now to FIGS. 9–11, a modified ignition coil is illustrated. This coil differs from the one that has been described in that, among other things, the magnetic circuit has been modified and the coil uses two shields instead of the single shield 72.

In FIG. 9, reference numeral 100 designates an open-ended case 100 that is formed of electrical insulating material. Disposed within the case is an ignition coil assembly generally designated as 102. This assembly is inserted into case 100 and a potting compound is then used to fill the case and encapsulate the assembly 102. A portion of this potting compound is shown and designated as 104.

The coil assembly 102 is comprised of magnetic parts 106 and 108 which are formed of the same composite material as parts 32 and 34. Part 108 has an annular portion 110 that has a circular outer surface or wall 112. Further, part 108 has an axially extending core portion 114 that has a bore 116 that is square in cross-section as shown in FIG. 10. The outer surface of core portion 114 is circular and wound thereon is a primary winding 118. Part 108 has a bar portion 120 (FIG. 10) that extends across the open end of bore 116.

Part 106 has an annular or circular outer surface or wall 122 and a bore 124 that is square in cross-section.

A magnetic core member 126, which is square in cross-section, is located in bore 116. The opposite ends of core 126 are located in corresponding square bore portions of parts 106 and 108 with the end of core 126 engaging bar 120. Core 126 is comprised of a stack or plurality of steel laminations as shown.

The ignition coil assembly has a secondary winding assembly 128 which is like previously described secondary winding 40. This winding is of the segment wound type and has a coil spool 130 formed of insulating material that carries the segment windings. The spool 130 has a plurality of circumferentially spaced tangs 132 at one end thereof and another plurality of circumferentially spaced tangs 134 at the opposite end thereof. There may be eight tangs on each end of the coil spool.

The ignition coil of the FIGS. 9–11 embodiment uses two steel shields 136 and 138 instead of a single shield 72. These shields have an arcuate or semi-circular shape as can be seen in FIG. 10. The shields can be formed of a magnetic material such as galvanized steel having a thickness of about 1.20 mm. Each shield has a pair of bent or struck radially inwardly extending integral tabs located at opposite ends thereof. The tabs on shield 136 are each designated as 140 and the tabs on shield 138 are each designated as 142.

The shields are assembled to magnetic parts 106 and 108 by inserting the tabs into radially extending recesses formed respectively in the outer end surfaces of parts 106 and 108. Thus, tabs 140 of shield 136 are inserted radially into recesses or grooves 144 and 146 formed respectively in parts 106 and 108. In a similar fashion, tabs 142 on shield 138 are inserted into corresponding recesses in parts 106 and 108. One of these recesses is shown in FIG. 10 and identified as 150. The tabs can be sprung apart when a pair of tabs is inserted so that after insertion they exert a clamping force on parts 106 and 108 to thereby hold parts 106 and 108 engaged and to thereafter prevent axial separation of these two parts.

When the shields 136 and 138 are assembled, inner surfaces thereof engage outer surfaces of coil spool tangs 132 and 134. These tangs engage the shields and the inner surfaces of these tangs engage respectively portions of cylindrical surfaces 112 and 122.

In the final assembled position of shields 136 and 138, they are separated by two axially extending gaps 152 and 154. Further, coil spool tangs 132 and 134 serve to space shields 136 and 138 from surfaces 112 and 122 to form radial air gaps between the shields and surfaces. The tangs may be about 1.0 mm. thick so that the radial air gap is also about 1.0 mm.

The following describes another modified magnetic circuit that is not illustrated in the drawings. In this modification, the magnetic circuit is comprised of two axially spaced magnetic parts each of which is like part 106 which are formed of the same type of material as parts 32 and 34. These parts are joined by an axially extending one-piece solid core member that has no internal bore and which carries a primary winding like primary winding 118. This part is formed of the same material as parts 32 and 34. The one-piece core member is cylindrical except for two end portions which are both square in cross section. The primary coil is wound on the cylindrical portion. The square end-portions are press-fitted into corresponding square openings in the two axially spaced magnetic parts. The square-end portions have a diameter that is less than the diameter of the cylindrical portion to provide opposed radially extending walls that respectively abut inner radial surfaces of the two magnetic of the two magnetic parts when the core member is assembled to the parts.

As has been described, various parts of the ignition coils are formed of a composite material of iron particles carried by a binder of electrical insulating material. The iron particles may have a mean particle size of about 0.004 inches. In production of a part, the iron particles are coated with a liquid thermoplastic material which encapsulates the individual particles. The coated iron particles are then placed in a heated mold or press where the composite material is compression molded to the desired shape or density. The final molded part is then comprised of iron particles in a binder of cured thermoplastic material. By way of example, the final molded part may be, by weight, about 99% iron particles and 1% plastic material. By volume, the part may be about 96% iron particles and 4% plastic material.

In the final molded part, the cured thermoplastic material binds the iron particles together and it also electrically insulates most of the particles from each other. Some of the particles may be engaged with no electrical insulation between them. However, for the most part, all of the particles are insulated from each other to provide a large number of gaps between particles that are of cured thermoplastic material. These gaps are like air gaps since the thermoplastic material has about the same permeability as air. Consequently, the composite material in effect produces a part that has in effect a multiplicity of minute air gaps. Because of this, the composite material is capable of storing magnetic energy in the gaps in a manner that is described hereinafter.

The following explains the operation and features of the ignition coil of this invention. With respect to the embodiment of FIGS. 1–8 when primary winding 36 is energized, magnetic flux is developed in the core comprised of telescoped core portions 32A and 34B. This flux passes into annular portion 34D and then across air gap 86 to cylindrical steel part 72. Flux now passes axially through part 72 and then through air gap 87 to annular portion 32B. It can be seen that the part 72 forms a low reluctance flux return path for the flux developed in the core. Further, it is evident that this flux passes radially through the air gaps 86 and 87. When the primary winding is deenergized, a large spark plug firing voltage is induced in the secondary winding of secondary assembly 40.

The air gaps 86 and 87 have a radial length of about 1.0 mm and the cross-sectional area of the air gaps is large as compared to conventional ignition coil air gaps that are in the coil core. This, assuming that the length of the surface 32D is about 7 mm., that the diameter of cylindrical surface 32D is about 40 mm. and that notch 32C is about 35 degrees wide the air gap area of gap 87, excluding the notch, is about $2\times3.14\times20\times325/360\times7$ or about 793 sq. mm. The air gap 86 has about the same area as the area of air gap 87. It, therefore, can be seen that the ratio of air gap length area A to air gap length L or A/L, which is a factor that determines coil inductance, will not vary much if the air gap length L varies during manufacture of the coil. Accordingly, the air gap length L can be held well within certain tolerances without adjusting it during the manufacture of the coil.

Further, by using a composite iron powder and insulating material for parts 32 and 34, the gaps between the particles of the composite material stores magnetic energy in addition to magnetic energy that is stored in air gaps 86 and 87. The total stored energy is related to the sum of the energy stored in parts 32 and 34 and the energy stored in air gaps 86 and 87. If the length of the air gaps 86 and 87 is decreased, the volume of these air gaps decreases, causing an increase in flux level due to an increase in inductance. The energy stored in these air gaps 86 and 87 decreases due to the decrease air gap volume. However, since the volume of the air gaps in the composite material of parts 32 and 34 has not changed, it will store more energy due to the increased amount of flux and cancel out most of the effect of the energy lost in the air gaps 86 and 87. The use of composite material for parts 32 and 34, therefore, further reduces the effect of variation in the air gap length L and is, therefore, self compensating. Putting it another way, the total magnetic energy stored in the magnetic circuit of the coil will not vary substantially for variations in air gap length L within a certain range.

The part 72 forms a low reluctance path for magnetic flux and it also provides a shield which has the effect of increasing the capacitance of the secondary winding. Thus, segment wound secondary windings have an inherent capacitance that is so low that under a open circuit condition, that is, where the secondary winding is not connected to a spark plug, extremely high secondary voltages of the order of 60–80 KV may be developed. These high secondary voltages induce high primary winding voltages which may cause failure of the electronic output device that is connected to the primary winding to switch primary winding current on and off. The part 72 increases the capacitance of the secondary winding such that primary peak reflected voltage can be limited to about 500 volts. This protects the electronic output device so that a clamping circuit for the electronic device is not required. The capacitance of the secondary winding is increased since there is capacitance between the secondary winding and part 72. The part 72 must be split and this is accomplished by the split or gap 74. The reason for the gap or split, is that without a split, the eddy currents developed in the part 72 would produce a shorted turn effect, which would decrease the efficiency of the coil. The use of part 72 as a flux return path increases the coupling between the primary and secondary coils as compared to a laminated stack of a leg of an "E" core. Further, the part 72 reduces the stray magnetic flux external to the coil structure, therefore, reducing electromagnetic radiation.

What has been described in regard to part 72 applies to the parts 136 and 138 of the FIGS. 9–11 embodiment. Thus, parts 136 and 138 perform the same functions as part 72 and part 72 could be replaced by two parts like parts 136 and 138 and vice versa. When using two parts, like parts 136 and 138, there are two splits or gaps.

In addition to the functions that have been described for shield parts 72, and 136 and 138, it is pointed out that they perform mechanical retaining or securing functions. Thus, in the embodiment of FIGS. 9–11 the parts 136 and 138 secure parts 106 and 108 together and in the FIGS. 1–8 embodiment part 72 performs a similar function.

In the magnetic circuit of the FIGS. 9–11 embodiment, the core within primary winding 118 is comprised of the laminated core member 126 and portion 114 of composite magnetic part 108. There are two parallel flux paths, namely a primary flux path through laminated core 126 and a secondary flux path through portion 114 which is parallel with the path through laminated core 126. The laminated core 126 has a lower reluctance than the reluctance of portion 114. What has been described provides an ignition coil that has a variable incremental inductance that varies as a function of the magnitude of break current applied to primary winding 118. Thus, the magnetic core is optimized for high permeance and high inductance at a low level of primary current for passage of flux through laminated core 126 and has a parallel flux path through portion 114 for a higher level of primary current with decreased inductance. This is accomplished, without greatly decreasing the coupling between the primary and secondary coils, and without saturating the primary flux path provided by core member 126. The low level of primary current, that is the current attained when the primary winding is deenergized (break amps) may be about 6.5 break amps. The higher level may be about 18.5 break amps.

When operating at the lower level of current (6.5 break amps) the magnetic circuit operates such that about 7% of the generated flux passes through portion 114 with 93% passing through laminated core member 126. When operating at 18.5 break amps, about 30% of the flux passes through portion 114 with 70% passing through core 126.

To further explain the variable incremental inductance feature of this invention, it will be appreciated that the incremental inductance of the coil is related to changes in B (flux density) caused by a change in H (magnetizing force) of the magnetic circuit of the coil. The incremental inductance is related to the change of B divided by the change in H that caused the change in B or $\Delta B/\Delta H$. Thus, if the B-H curve is a straight line (linear relationship) the incremental inductance remains substantially constant because a given change in H produces the same change in B.

The total inductance of the coil is the inductance related to laminated core 126 added to the inductance related to core portion 114. The B-H curves of core 126 and core portion 114 are not the same. Thus, for a certain lower break current range, the B-H curve for core 126 is linear so that the inductance ($\Delta B/\Delta H$) remains substantially constant over a certain current range. However, this linear curve is such that there are relatively large changes in B for given change in H. The B-H curve for portion 114 also has a linear portion over a lower current range so that the inductance related to it remains constant over the current range. The ratio $\Delta B/\Delta H$ for portion 114 is less than the ratio $\Delta B/\Delta H$ for laminated core 126. As current goes above a certain level, for example 6.5 break amps, the B-H curve for portion 114 makes a transition from a straight line to a non-linear curved portion where the ratio $\Delta B/\Delta H$ progressively decreases thereby decreasing inductance at currents above 6.5 break amps. This curved non-linear portion curves away from the B axis (ordinate) and toward the H axis (abscissa).

From what has been described, it will be apparent that the ignition coil provides a dual mode operation. Thus, if the break-amp current is about 6.5 amps, the coil will have a certain fairly constant inductance that is selected to provide a desired burn-time for normal ignition system operation. However, if the break-amp current is increased to, for example, 18.5 amps the ignition coil will have an incremental inductance that decreases as current increases from 6.5 to 18.5 amps. Thus, the inductance related to core 126 remains constant, but there is a substantial reduction in incremental inductance provided by portion 114 with the result that above 6.5 break-amps, the total incremental inductance decreases. Since inductance decreases as primary current goes from 6.5 to 18.5 amps, that change in current will be a fast rise (lower inductance) that that the coil will now deliver a fast rise higher secondary current that is suitable for firing a fouled plug. Thus, 18.5 amp break current could be used for cold starting and 6.5 break-amps for normal operation. The coil operates such that as compared to a conventional coil that is capable of high secondary currents, the burn-time is not sacrificed.

The FIG. 5 embodiment of the invention also has a variable inductance that varies with the magnitude of the applied primary break current. Thus, in FIG. 5 the B-H curve for core portions 32A and 34A, which are formed of composite material, is such that for a certain range of low primary winding break current, $\Delta B/\Delta H$ remains substantially constant to provide a constant incremental inductance. This range, for example, may be up to 6.5 amps. If break current is increased to above 6.5 amps, the B-H curve goes from a straight line (linear) to a curved portion where $\Delta B/\Delta H$ decreases with increasing current thereby providing a decreasing incremental inductance with increasing current above 6.5 amps. The decreasing inductance with increasing current effect produced by the FIG. 5 embodiment is not as pronounced as the effect produced by the FIGS. 9–11 embodiment.

As has been described, in connection with the FIGS. 1–8 embodiment, magnetic energy is stored in parts 32 and 34 and in the air gaps 86 and 87. The embodiment of FIGS. 9–11 operates in the same manner, that is, magnetic energy is stored in parts 106 and 108 and in the air gaps between surfaces 112 and 122 and shields 136 and 138. The total stored magnetic energy will not vary substantially for variations in the air gap length for the same reasons that have been set forth in describing the operation of the FIGS. 1–8 embodiment. Moreover, the cross sectional area A of the air gaps is large as compared to air gap radial length L in the FIGS. 9–11 embodiment for the same reasons as has been described in connection with the description of the FIGS. 1–8 embodiment. Thus, the ratio A/L for the FIGS. 9–11 embodiment can be about the same or slightly less than the A/L ratio of the FIGS. 1–8 embodiment.

The embodiments of the invention in which an exclusive property or privilege is claimed are defined as follows:

1. An ignition coil comprising, first and second axially spaced magnetic parts each formed of iron particles in a binder of electrical insulating material that serves to bind the particles together and to provide gaps between at least some of the particles, a core means formed of magnetic material magnetically connecting said parts, a primary winding disposed about said core means, a secondary winding disposed about said primary winding, and at least one axially extending member formed of magnetic material located outside of said secondary winding for magnetically connecting said parts, said axially extending member being positioned to provide radially extending air gaps respectively between inner surfaces of said axially extending member and outer surfaces of said first and second parts.

2. The ignition coil according to claim 1 where said axially extending member mechanically connects said first and second parts.

3. The ignition coil according to claim 1 where said secondary winding is segmented and where said axially extending member forms a shield that is operative to increase the capacitance of said secondary winding.

4. The ignition coil according to claim 1 where the area A of said air gaps is large as compared to the radial length L of the air gaps whereby the ratio A/L does not change substantially with variations in L.

5. The ignition coil according to claim 1 where magnetic energy is stored in the gaps between the iron particles and is stored in the radially extending air gaps, the total stored magnetic energy being the sum of the energy stored in the gaps between the particles and the energy stored in the radially extending air gaps, said total magnetic energy being substantially uneffected by variations in the radial length of the air gaps.

6. An ignition coil comprising, first and second axially spaced magnetic parts each having a circular outer surface, an axially extending core means formed of a magnetic material magnetically connecting said first and second parts, a primary winding disposed about said core means for generating magnetic flux, a secondary winding disposed about said primary winding, and an annular axially extending member formed of magnetic material disposed about said secondary winding, said axially extending member being positioned to provide first and second radially and circumferentially extending air gaps between inner surfaces of said axially extending member and said respective circular outer surface of said first and second parts, said axially extending member having a gap that extends the entire length of said member.

7. The ignition coil according to claim 6 where said first and second magnetic parts and said core means are all formed of a composite magnetic material that is comprised of iron particles in a binder of electrical insulating material.

8. The ignition coil according to claim 6 where the secondary winding is carried by a coil spool that has circumferentially spaced and axially extending tangs at opposite ends thereof, said tangs being disposed between respective circular outer surfaces of said first and second parts and inner surfaces of said axially extending member.

9. The ignition coil according to claim 6 where said axially extending member forms a shield that is operative to increase the capacitance of the secondary winding.

10. An ignition coil comprising, first and second axially spaced magnetic parts each formed of iron particles in a binder of electrical insulating material that serves to bind the particles together and to provide gaps between at least some of the particles, each said part having a circular outer surface, an axially extending core means formed of magnetic material magnetically connecting said first and second parts, a primary winding disposed about said core means for generating magnetic flux, a secondary winding disposed about said primary winding, and a plurality of circumferentially spaced and axially extending members formed of magnetic material disposed about said secondary winding, each member having a circular shape and being positioned to provide radially extending air gaps between inner surfaces of said members and said respective outer circular surfaces of said first and second parts.

11. The ignition coil according to claim 10 which has two axially extending members.

12. The ignition coil according to claim 10 where said secondary winding is segmented and where said plurality of axially extending members form a shield that is operative to increase the capacitance of the secondary winding.

13. An ignition coil comprising, magnetic means having end portions joined by an axially extending core portion, said end portions having circular outer surfaces, a primary winding disposed about said core portion, a secondary winding disposed about said primary winding carried by a coil spool that is formed of electrical insulating material, at least one circular axially extending member formed of magnetic material for magnetically connecting said circular outer surfaces of said parts, and first and second means integral with and located at opposite ends of said coil spool engaging inner surfaces of said axially extending member to radially space and provide radially extending air gaps between inner surfaces of said axially extending member and said outer circular surfaces of said end portions.

14. The ignition coil according to claim 13 where said first and second means is each comprised of a plurality of axially extending and circumferentially spaced tangs that are disposed between inner surfaces of said axially extending member and said circular outer surfaces of said end portions.

15. An ignition coil comprising, a first part formed of magnetic material having an end portion and an axially extending portion, said first part having a bore extending through the end portion and through the axially extending portion, a second part formed of magnetic material having an end portion and an axially extending portion disposed within the bore of said first part, said first and second parts each formed of a composite magnetic material comprised of iron particles in a binder of electrical insulating material, said insulating material providing gaps between iron particles, a primary winding disposed about the axially extending portion of said first part, a secondary winding disposed about said primary winding, and means formed of magnetic material located outside of said secondary winding for magnetically connecting the end portions of said first and second parts through air gaps, said means being spaced respectively from said end portions of said first and second parts to form said air gaps between said means and said end portions of said first and second parts.

16. The ignition coil according to claim 15 where magnetic energy is stored in the gaps between the particles of the composite material and is stored in the air gaps, the total stored magnetic energy being the sum of the energy stored in the gaps between the particles and the energy stored in the air gaps, said total magnetic energy being substantially uneffected by variations in the length of the air gaps.

17. The ignition coil according to claim 15 where said end portions of said first and second parts have circular outer surfaces and where said means formed of magnetic material has a circular shape, inner circular surfaces of said means being spaced from said outer circular surfaces of said parts to form said air gaps.

18. The ignition coil according to claim 15 where said bore in said first part and the axially extending portion of said second part have complementary rectangular cross-sections.

19. The ignition coil according to claim 15 where said first and second parts have interference fit means operative to secure the parts from axial separation.

20. The ignition coil according to claim 15 where the axially extending portion of said first part has a circular outer surface and where inner turns of said primary winding directly engage said surface.

21. An ignition coil comprising, a first part formed of magnetic material having an end portion and an axially extending portion that has a bore, a second part formed of magnetic material having a bore, said second part engaging an end of said axially extending portion of said first part, said first and second parts being formed of iron particles carried by a binder of electrical insulating material that serves to bind the particles together and to provide gaps between at least some of the particles, a core member formed of a plurality of steel laminations disposed within said bores of said first and second parts, a primary winding disposed about the outer surface of the axially extending portion of said first part, a secondary winding disposed about said primary winding, and an axially extending member located outside of said secondary winding for magnetically connecting the end portions of said first and second parts through radially extending air gaps, said end portions being axially spaced, said member formed of magnetic material being respectively radially spaced from said end portions of said first part and from said second part to provide said radially extending air gaps.

22. The ignition coil according to claim 21 where the end portion of said first part and said second part each have circular outer surfaces and where said member formed of magnetic material has a circular inner surface spaced from said outer circular surfaces of said end portions of said first and second parts to form said radially extending air gaps.

23. An ignition coil that has an incremental inductance that varies as a function of the magnitude of primary winding current comprising, a core means formed of a first core part that is comprised of a plurality of steel laminations that are disposed within a second core part that comprises a tubular member that is formed of iron particles in a binder of electrical insulating material, a primary winding disposed about said core means, a secondary winding disposed about said primary winding, said first and second core parts providing first and second parallel paths for flux developed by energization of said primary winding, the B-H characteristics of the magnetic material of said first and second core parts being different and being such that when primary winding current exceeds a predetermined value the incremental inductance of the ignition coil decreases.

24. An ignition coil that has an incremental inductance that varies as a function of the magnitude of primary winding current comprising, magnetic core means having end portions joined by an axially extending core portion, said magnetic core means being formed of a composite material comprised of iron particles in a binder of electrical insulating material, said end portions having circular outer surfaces, a primary winding disposed about said axially extending core portion, a secondary winding disposed about said primary winding, a flux carrying part formed of magnetic material located outside of said secondary winding having circular surfaces spaced from said circular outer surfaces of said end portions to form radially extending air gaps, the B-H characteristic of said composite material being such that for a low range of primary winding current the incremental inductance of said coil remains substantially constant and being such that when primary winding current exceeds a predetermined value, the incremental inductance decreases.

* * * * *